United States Patent [19]

Foley, Jr.

[11] 3,989,000

[45] Nov. 2, 1976

[54] OUTBOARD MOTOR ELECTRIC STEERING CONTROL

[75] Inventor: John D. Foley, Jr., Shreveport, La.

[73] Assignee: Ram-Glas Products, Inc., Little Rock, Ark.

[22] Filed: Aug. 11, 1975

[21] Appl. No.: 603,675

[52] U.S. Cl. ..... 115/18 E; 64/30 D; 64/30 E; 114/144 R

[51] Int. Cl.[2] ..... B63H 21/26

[58] Field of Search ..... 115/18 R, 18 E; 114/144 R, 153; 64/30 R, 30 E, 30 D, 28 R

[56] References Cited

UNITED STATES PATENTS

| | | | |
|---|---|---|---|
| 2,848,884 | 8/1958 | Maude | 64/30 R |
| 2,877,733 | 3/1959 | Harris | 115/18 E |
| 3,201,953 | 8/1965 | Firth | 64/30 R |
| 3,424,287 | 1/1969 | Dreiding | 64/30 R |
| 3,587,512 | 6/1971 | Patterson | 114/153 |
| 3,606,858 | 9/1971 | Edwards et al. | 115/18 R |

*Primary Examiner*—Trygve M. Blix
*Assistant Examiner*—Charles E. Frankfort
*Attorney, Agent, or Firm*—Hill, Gross, Simpson, Van Santen, Steadman, Chiara & Simpson

[57] ABSTRACT

An outboard vertical axis electric trolling motor has a combination power transmission means and clutch between the steering motor and the pivot shaft wherein the surface of a pulley wheel is covered with deformable elastic material such as O-rings to form temporary teeth upon engagement with timing belt teeth. A thrust-direction indicating pointer is linked to the wheel on the pivot shaft.

11 Claims, 6 Drawing Figures

Fig. 5
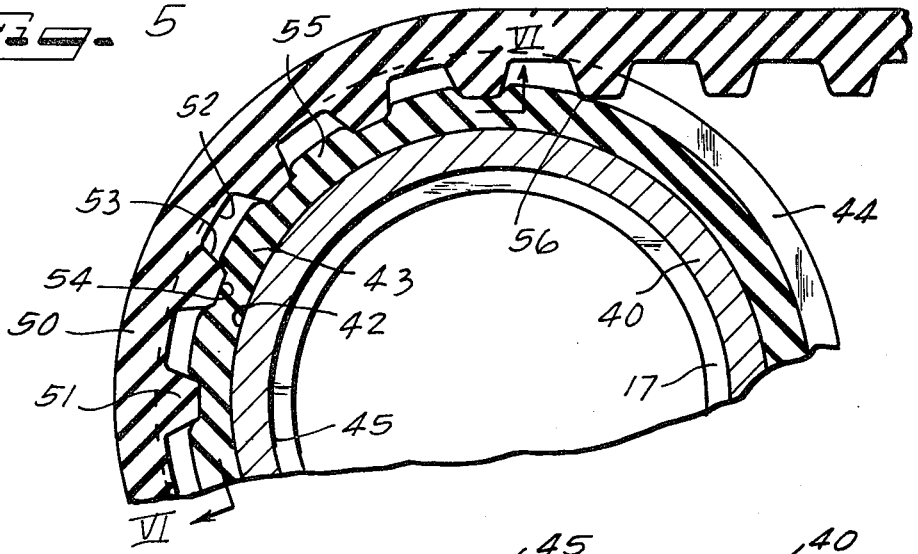
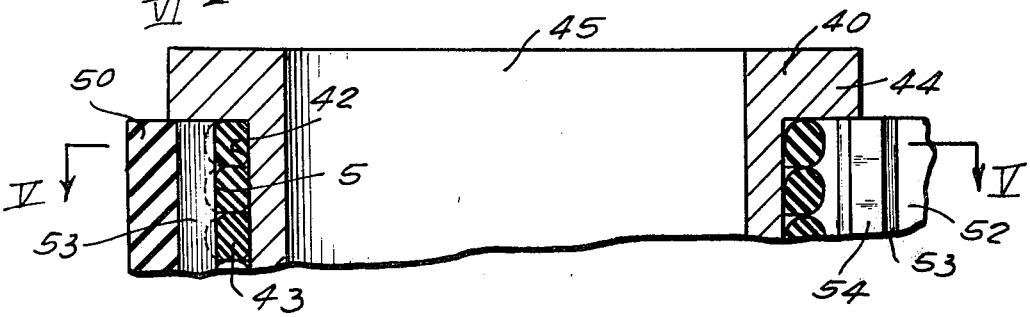
Fig. 4
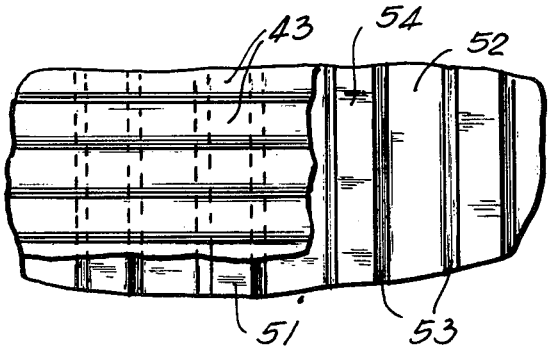
Fig. 6

OUTBOARD MOTOR ELECTRIC STEERING CONTROL

BACKGROUND OF THE INVENTION

1. Field of the Invention

The present invention relates particularly to electric steering control means for outboard trolling motors.

2. The Prior Art

Electric trolling motors are well known in the art, commonly having an electric propulsion unit mounted at the lower end of a pivot shaft, with electric wires threaded through the hollow shaft and out the top thereof to a power control source. Steering of the boat is accomplished by rotating the pivot shaft within a shaft tube or collar fixed to the boat, by a mechanism in a head located atop the shaft tube.

U.S. Pat. No. 2,877,733, for example, shows a vertical axis motor affixed to a pivot shaft and rotating the shaft with respect to an outer collar by means of a gear train. That same patent also discloses a fiber-disc slip clutch between the steering motor output shaft and the gear train.

U.S. Pat. No. 3,052,204 shows an electric outboard motor unit having a hollow steering drum about which is wrapped a flexible cable, the free ends of which are attached to foot pedals for rotation of the steering shaft upon which the drum is mounted. U.S. Pat. No. 1,764,388 shows an arrangement employing a pulley on the propulsion unit pivot shaft.

SUMMARY OF THE INVENTION

In the outboard trolling motor of the present invention, a vertical-axis electric steering motor drives a circumferentially continuous toothed timing belt via an output wheel affixed to the output shaft of the motor. The output wheel constitutes a timing gear wheel having teeth and notches on its radially outer surface for engaging the drive belt. A deformable elastic material is placed on the driven surface of a torque pulley affixed to a pivot shaft and teeth are temporarily formed therein for a positive drive upon engagement with the teeth of the belt. The deformable material conveniently may constitute a plurality of 0-rings engaged about the drive surface. The rings slip when the propulsion unit is jammed but transmit sufficient force to the drive pulley to rotate the pivot shaft and propulsion unit under normal circumstances.

BRIEF DESCRIPTION OF THE DRAWINGS

FIG. 4 is a fragmentary cross-sectional view taken on line IV—IV of FIG. 3.

FIG. 5 is a fragmentary cross-sectional view taken on line V—V of FIG. 4.

FIG. 6 is a flattened circumferential view, or development, taken on line VI—VI of FIG. 5.

DESCRIPTION OF THE PREFERRED EMBODIMENTS

Figure 1:
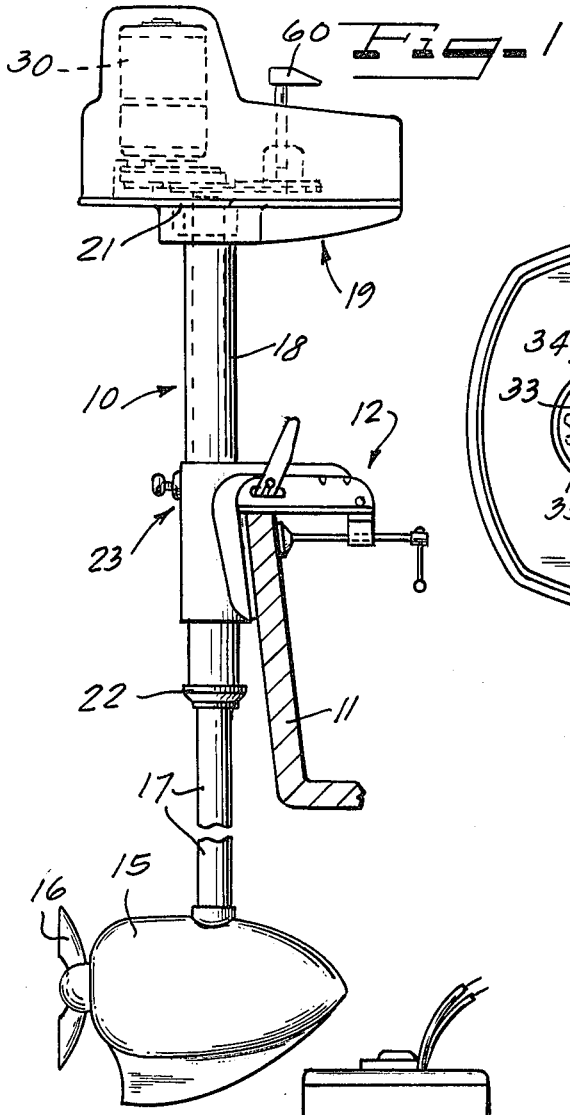
FIG. 1 is a general elevation view of an electric trolling motor utilizing the present invention.
Figure 3:
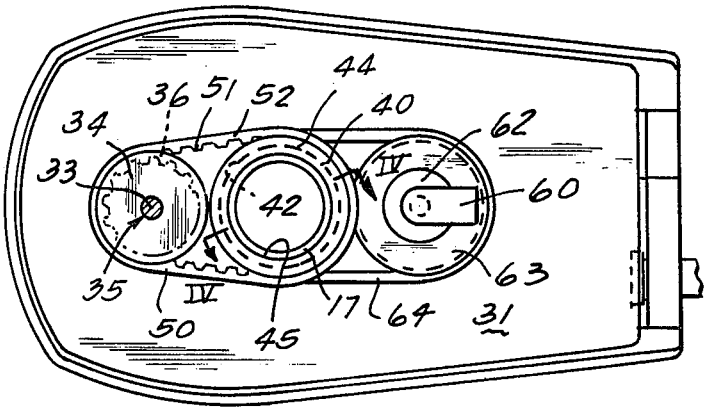
FIG. 3 is a cross-sectional view taken on line III—III of FIG. 2.
Figure 2:
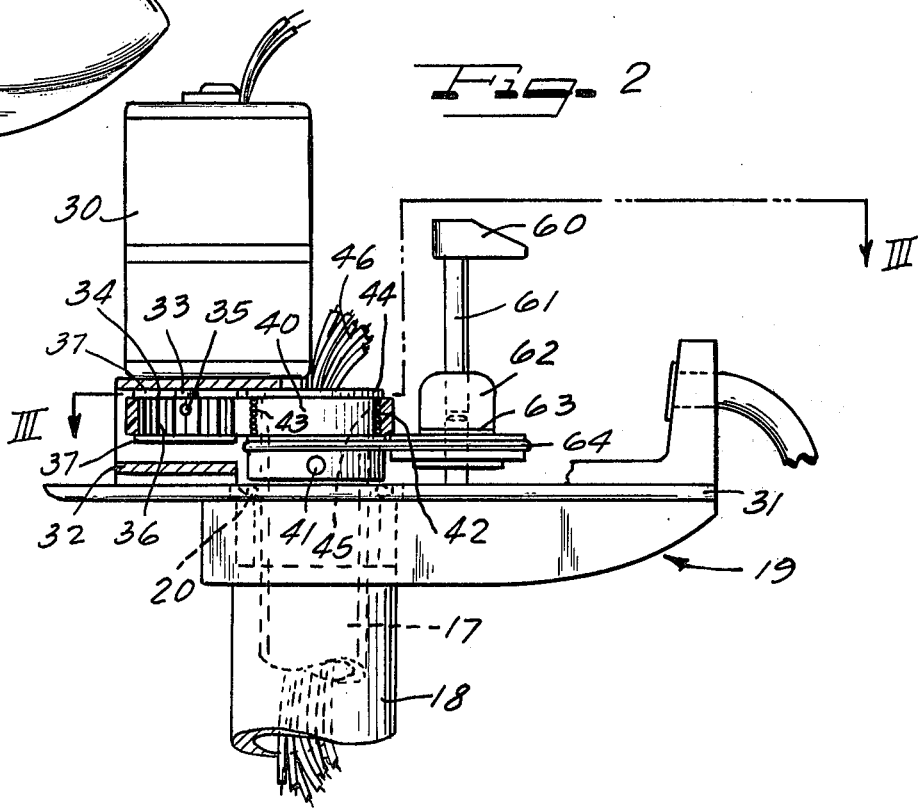
FIG. 2 is a fragmentary side view through the head of the outboard motor, partially in section through the drive belt and frame.

An electric outboard trolling motor 10 is shown in FIG. 1 affixed to a boat transom 11 by a convenient clamping means 12. The motor 10 has a propulsion unit 15 *typically enclosing an electric motor* (not shown) which drives directly a propeller 16. The unit 15 is affixed to a pivot shaft 17 which extends vertically out of the water and through a shaft tube 18 to a head assembly 19. The pivot shaft 17 is mounted rotatably with respect to the non-rotatable shaft tube 18 by means of ball bearings 20 (FIG. 2) arranged therebetween at the upper and lower ends thereof, at 21 and 22. The tube 18 is slidably connected to the clamping means 12 by means of a lockable slip joint 23.

Within the head assembly 19, an electric steering motor 30 is supported vertically with respect to base member 31 by means of a frame 32. The steering motor 30 has internal gear reduction between the motor armature and a motor output shaft 33. An output wheel 34 is affixed to the output shaft 33 of the motor 30, by means of a pin connection 35. The output wheel 34 comprises a timing gear having a series of circumferentially spaced teeth and notches 36 set radially inwardly of a pair of axially spaced rims or flanges 37.

A torque wheel 40 is affixed atop the pivot shaft 17 by a pin 41 so that the pivot shaft 17 and wheel 40 rotate together. The torque wheel 40 is somewhat larger in diameter than the output wheel 34 and has a smooth circumferentially continuous peripheral cylindrical surface 42 disposed between a pair of axially spaced flanges 44. The torque wheel 40 is annular in form, having a central aperture 45 to allow a substantial number of electric wires 46 to pass therethrough. In this regard, solid state motor speed control circuits having components near or within the propulsion unit 15 require a greater number of such wires 46 than the one or two found in prior art motors. Thus, the central aperture 45 may be formed considerably larger than has been heretofore possible and readily accommodates an increased number of wires.

In order to transfer power from the electric steering control motor 30 to the pivot shaft 17 by way of the output wheel 34 and the wheel 40, there is provided a timing belt 50 having regularly-spaced, radially-inwardly projecting teeth 51 separated by recesses 52 therebetween. The teeth 51 have angled shoulders 53 joining a face 54 of each tooth 51 with the recess 52. The material of the timing belt is rubber or synthetic rubber. However, the duramater characteristics of the belt are such that the teeth 51 are fairly rigid.

In accordance with the principles of the present invention, the peripheral surface 42 of the wheel 40 is particularly characterized by having disposed thereon a cushion made of an elastic, deformably resilient material extending over the entire circumferential area lying between the flanges 44. In the form of the invention shown, a plurality of "O" rings made of rubber or synthetic rubber are disposed in an axial row in side-by-side relation to form the elastic cushion. Other equivalent means could also be provided such as heavy rubber bands. In any event, there is formed by the resilient material an elastic circumferentially continuous peripheral surface 43 capable of a special torque transmitting function. The teeth 51 of the timing belt 50 engage the toothed surface 36 of the output wheel 34 and also the deformable surface 43 provided by the elastic material or "O" rings extending about the surface 42 of the torque wheel 40. Thus, there is a special interaction whereby the teeth 51 depress and deform the surface 43 in conforming shape and form temporary teeth portions 55 on the radially outward surface of the flexible material 43. The teeth 51 deform the material 43 as at 56 in FIG. 5 to achieve positive engagement between the belt 50 and the deformable material 43. However, the material forming the surface 43 has only a frictional contact with the driven surface 42 of the torque wheel 40. Such friction depends on the friction coefficient of the material 43 employed and the radially-inward force exerted by the material 43 upon the surface 42 arising from the stretching of the material to place it onto the surface. When the frictional force between the material 43 and the driven surface 42 is overcome, as when the propulsion unit 15 on the pivot shaft 17 is jammed for any reason, the material 43 will slip about the surface 42 rather than break the wheel or the shaft to protect the steering motor 30 against overload or damage.

While the above-described structure transfers rotational movement between the output shaft 33 of the motor 30 and the pivot shaft 17 carrying the drive unit 15, it is also desirable to provide an indicator for identifying to the operator the thrust direction of the motor 10. Such a device 60 is shown in the various figures. The pointer 60 is carried by a stem 61 which is removably engaged with a rotatable socket 62. The socket 62 is, in turn, carried by an idler pulley 63 which is supported rotatably in the frame 31 of the head 19. A light drive belt 64 engages both the drive wheel 40 and the idler pulley 63 in sheaves of the same diameter. Thus, the pointer 60 will rotate through the same angular displacement as does the pivot shaft 17 and the propulsion unit 15, regardless of any slippage between the belt 50 and the drive wheel 40.

While I have disclosed the provision of an elastic surface 43 on the torque wheel 40, it should be understood that elastic material may be placed upon the output wheel 34 and the torque wheel 40 be a timing gear, or both wheels 34 and 40 may have elastic material on their drive faces.

Various modifications might be suggested by those versed in the art, however, I wish to embody within the scope of the patent warranted hereon all such modifications as reasonably and properly come within the scope of my contribution to the art.

I claim as my invention:

1. In an outboard motor steering control having a vertical-axis electric steering motor for selectively rotatably orienting a pivot shaft carrying a propulsion device, the improvement of power transmission and slip clutch means between an output of the steering motor and the pivot shaft, comprising:

an output wheel driven by the steering motor output and having teeth means engageable with an endless loop having corresponding teeth means therein; and a torque wheel driven by said loop and having teeth means engageable with said loop, said torque wheel being attached corotatably to said pivot shaft; and wherein said teeth means on at least one of said output and torque wheels comprise portions of elastic deformable material spaced between said corresponding teeth means of said endless loop.

2. The improvement of claim 1, wherein said elastic deformable material comprises O-rings fitted over a drive surface of said one of said output and torque wheels.

3. In an outboard motor steering control having a vertical-axis electric steering motor and a pivotable shaft to orient rotatably a propulsion device affixed to said shaft, the improvement of power coupling means in said steering control comprising:

an output wheel driven by said steering motor and a torque wheel affixed to said shaft, each of said wheels having a circumferential drive face, a deformable elastic material about one of said drive faces of said wheels, and the other drive face of said wheels having rigid teeth; and a belt drivingly engaging said wheels via the elastic material on said drive face of one of said wheels, the belt having teeth on a radially-inward surface thereof corresponding to said rigid teeth of said drive face on the other of said wheels and engageable with said elastic material to deform same temporarily and improve the driving forces therebetween.

4. The improvement defined in claim 3, wherein the deformable elastic material comprises a plurality of O-rings, each ring sized to engage elastically said one of said drive faces of said wheels.

5. The improvement of claim 4, wherein said torque wheel has a second drive face engaging a second belt means which, in turn, engages an idler pulley and orients an exposed pointer means carried thereon, thereby to provide a visible indication of a thrust direction of the propulsion device.

6. In an outboard motor steering control having a vertical axis electric steering motor for selectively rotatably orienting a pivot shaft carrying a propulsion unit, the improvement of power transmission and slip clutch means between an output of said steering motor and the pivot shaft, comprising:

a timing belt having radially inwardly-extending teeth;

an output wheel affixed irrotatably upon said motor output and a torque wheel affixed irrotatably upon said pivot shaft; and an elastic, deformable material frictionally engaged about a circumferential surface of one of said output and torque wheels, said material also engaging said timing belt by teeth means formed in said deformable material by said teeth in said belt.

7. The improvement of claim 6, wherein said elastic material comprises a plurality of O-rings fitted in axial relation upon a cylindrical drive surface of said one of said wheels.

8. The improvement of claim 6, wherein one of said output and torque wheels is a timing gear wheel positively engaging said timing belt.

9. The improvement of claim 6, wherein said torque wheel has a second drive surface engaging a second belt means which engages an idler pulley for turning with said torque wheel and pivot shaft, said idler pulley carrying a pointer means visible to an operator of said steering control.

10. In a boat motor, the improvement of a peripherally toothed wheel adapted to be rotatably driven by a motor, a shaft adapted to be rotatably coupled to said toothed wheel selectively for angular displacement thereby, a torque wheel on said shaft, said torque wheel having a smooth circumferentially continuous peripheral surface, a cushion on said smooth circumferentially continuous peripheral surface of said wheel formed by a resilient and elastically deformable material, and a belt extending between and trained over both of said wheels to link said wheels in driving and driven relation, said belt having inwardly extending teeth meshing with the teeth on the toothed wheel for positive drive thereby, said teeth of said belt engaging and elastically deforming said cushion to form a temporary tooth surface for meshing with said belt, whereby the driving relationship between the motor and the shaft is improved.

11. In a boat motor as defined in claim 10, said cushion and said smooth surface of said torque wheel forming a slip clutch yieldable under abnormal loads to prevent physical damage to the motor.

* * * * *